US005931448A

United States Patent [19]

Sicking et al.

[11] Patent Number: 5,931,448

[45] Date of Patent: Aug. 3, 1999

[54] REVERSE TWIST TURNED-DOWN TERMINAL FOR ROAD GUARDRAIL SYSTEMS

[75] Inventors: Dean L. Sicking; John D. Reid, both of Lincoln, Nebr.; Gene W. Paulsen, Wichita, Kans.

[73] Assignee: The Board of Regents of the University of Nebraska, Lincoln, Nebr.

[21] Appl. No.: 08/780,164

[22] Filed: Dec. 26, 1996

Related U.S. Application Data

[60] Provisional application No. 60/009,470, Dec. 28, 1995.

[51] Int. Cl.[6] ..... E01F 15/04

[52] U.S. Cl. ..... 256/13.1; 404/6

[58] Field of Search ..... 256/13.1; 404/6, 404/9; 188/373, 375, 371

[56] References Cited

U.S. PATENT DOCUMENTS

| | | | |
|---|---|---|---|
| 2,091,925 | 8/1937 | Heltzel | 256/13.1 |
| 3,820,910 | 6/1974 | Morrett, Jr. | 256/13.1 X |
| 4,784,515 | 11/1988 | Krage et al. | 256/13.1 X |
| 5,069,576 | 12/1991 | Pomero | 256/13.1 X |
| 5,348,416 | 9/1994 | Ivey et al. | 256/13.1 X |

*Primary Examiner*—Anthony Knight
*Attorney, Agent, or Firm*—Vincent L. Carney

[57] ABSTRACT

A turned-down terminal for a guardrail system has a drop-down section and a turned-down section formed by twisting the guardrail clockwise to be at an angle causing sufficient force and torque to pull at least a portion of the drop-down section of the guardrail barrier free upon being impacted with a vehicle. Back-up plates are bolted to the posts and to the guardrail.

15 Claims, 5 Drawing Sheets

FIG. 13
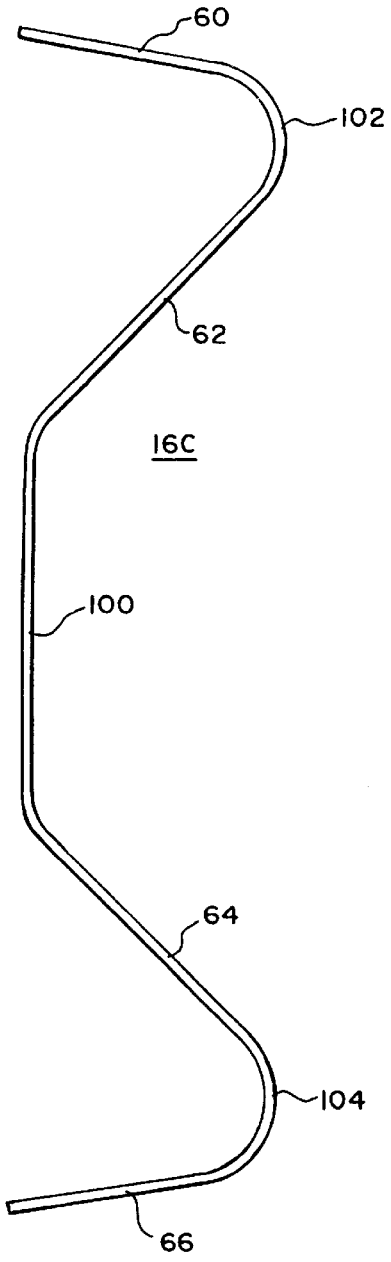
FIG. 14
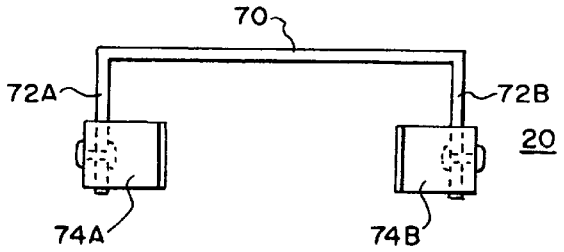
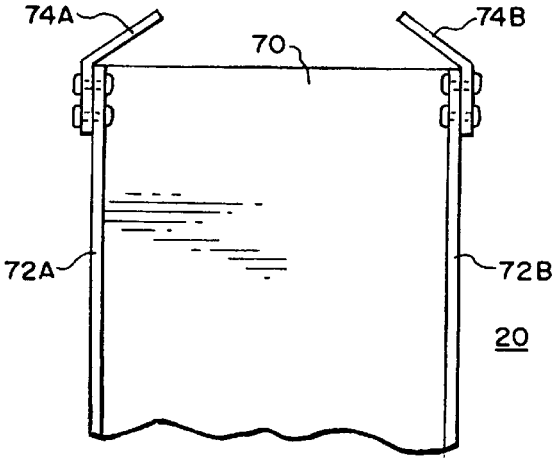
FIG. 15

REVERSE TWIST TURNED-DOWN TERMINAL FOR ROAD GUARDRAIL SYSTEMS

RELATED CASES

This application is a continuation-in-part of U.S. provisional application 60/009470 filed Dec. 28, 1995, for REVERSE TWIST TURNED-DOWN TERMINAL FOR ROAD GUARDRAIL SYSTEMS.

BACKGROUND OF THE INVENTION

This invention relates to guardrail systems, and more particularly, to turned-down guardrail systems.

In one type of turned-down guardrail system, the guardrail barrier at the terminal slopes downwardly to ground level from normal level, which is approximately 29 inches from the ground. It is known to form the turned-down end by twisting the guardrail barrier at the end of the last support post and bending it to the ground level. The end terminal is turned-down to avoid spearing vehicles that hit it at the end rather than on the side of the barrier.

Some turned-down terminals include a drop-down barrier section supported by posts downstream of the guardrail barrier that permit the guardrail barrier to drop to the ground upon impact of the turned-down section by a vehicle. This drop-down section is designed to fall immediately from the support posts to a low level upon being impacted. The drop-down guardrail barrier is held by fastening means which release when a vehicle hits the end terminal so that the guardrail drops downwardly. In such systems, the motion of the vehicle is attenuated by hitting breakaway support posts for the guardrail.

The prior art drop-down guardrail barriers may include any of several types of fasteners to fasten the guardrails to the post. For example, in some prior art embodiments, a back-up plate is bolted to the post and mild steel straps are utilized to mount the barrier to the back-up plate. An offset block (block out or other unit) may be bolted to the post between the back-up plate and the post. Generally, a given number of posts such as seven or eight include the strap holding the guardrail barrier and an offset block whereas the guardrail barrier sections spaced further from the turned-down terminal end are bolted directly to the post.

Other prior art systems do not use metal straps but instead rely upon connecting the barrier to a back-up plate shaped complementarily such as for example with clips or bolts. The guardrail barrier may be W-beam or C-beam types or any other type of barrier. At the turned-down end, the prior art guardrail barriers are twisted flat in a counterclockwise direction and bent downwardly to the ground where they are fastened.

The prior art turned-down terminals have some disadvantages, such as: (1) vibrations due to traffic along the roadway and temperature changes cause release of some of the clip type fasteners, causing some guardrails to drop without being impacted by a vehicle; (2) under some circumstances, some vehicles impacting the guardrail terminal are launched into the air and turn over, primarily because the fasteners do not release the drop-down section, resulting in the turning over of the vehicles; and (3) some back-up plates such as those formed complementarily with W-beams do not release reliably in the drop down sections because the overlapping portions of the guardrail barrier and back-up plate hold the guardrail barrier in place.

SUMMARY OF THE INVENTION

Accordingly, it is an object of the invention to provide a novel guardrail system.

It is a further object of the invention to provide a novel turned-down terminal for guardrail systems.

It is a still further object of the invention to provide a novel turned-down guardrail terminal which reduces the tendency to launch vehicles.

It is a still further object of the invention to provide a novel turned-down guardrail terminal in which a drop-down section of barrier remains fastened to the posts at the end until impacted by a vehicle and then reliably drops.

In accordance with the above and further objects of the invention, the guardrail barriers for some of the posts in the drop-down section near the end of the guardrail system downstream of the turned-down section are bolted to back-up plates, and at other posts, the guardrail barriers are nested into or supported by backup plates mounted to the posts. The posts are generally break-away posts having an opening near their bottom end to facilitate their breaking away. At the turned-down section, the guardrail barrier is twisted in a clockwise direction and bent downwardly to the ground.

The back-up plate and the direction of twist of the guardrail are designed to hold the guardrail barrier in place unless impacted at its end by a vehicle but applies sufficient force away from the post to cause it to drop away from the modified back-up plate when impacted by a vehicle. Certain of the back-up plates are constructed to avoid locking of the guardrail barrier and back-up plates caused by the weight of the vehicle such as for example by exerting sufficient downward force between the lower curved portions of the nested guardrail and barrier in which the barrier surface is above the back-up plate in W-beam shaped guardrails and back-up plates.

From the above description, it can be understood that the turned-down guardrail terminal of this invention has several advantages, such as for example: (1) it is firmly held in place and not subject to being loosened and falling because of variations in temperature and vibrations on the roadway; and (2) it reliably drops away without launching vehicles upon impact of the terminal by the vehicle.

SUMMARY OF THE DRAWINGS

The above noted and other features of the invention will be better understood from the following detailed description when considered with reference to the accompanying drawings in which:

FIG. 13 is a side elevational view of still another barrier;

FIG. 14 is a top view of an anchor in accordance with an embodiment of the invention; and FIG. 15 is a front elevational view of the anchor of FIG. 14.

DETAILED DESCRIPTION

Figure 1:
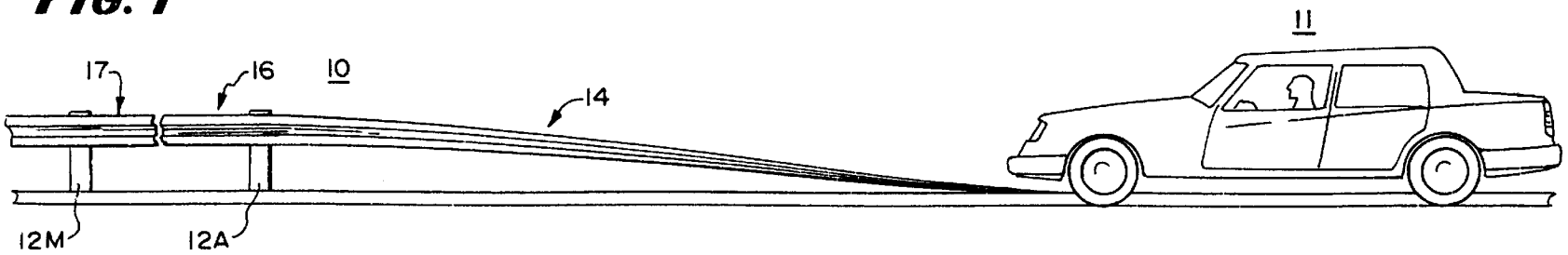
FIG. 1 is a simplified elevational view of an embodiment of the invention.

In FIG. 1, there is shown a simplified fragmentary elevational view of a turned-down guardrail system 10 positioned with a vehicle 11 about to impact it on its end. The turned-down guardrail system 10 has a turned-down barrier section 14 and a horizontal drop-down section 16 which joins the more-firmly bolted portion 17 in a manner to be described more fully hereinafter. A rail or beam such as a W-beam is hereinafter referred to as a barrier.

The turned-down barrier section 14 of the guardrail system 10 is twisted in a direction that is clockwise when facing the terminal from the end of the terminal opposite to the start of the drop-down section. The guardrail barrier has a front side that normally faces away from the posts and a rear side that normally faces the posts. When the turned-down barrier section is twisted, the front side of the guardrail barrier is turned so that the front side substantially faces the ground. The clockwise twist forms a surface that the vehicle 11 impacts to pull the turned-down barrier section 14 and the drop-down section 16 of the guardrail barrier from the posts in the drop-down barrier section 16. The vehicle 11 is then slowed down by impacting the conventional break-away post assemblies, one of which is shown at 12A. Additional post assemblies and guardrail barriers are fastened more conventionally, such as by having the guardrail directly bolted to the posts. These post assemblies and guardrail barriers are illustrated by the guardrail portion 17 and by the post assemblies, one of which is shown at 12M.

Figure 2:
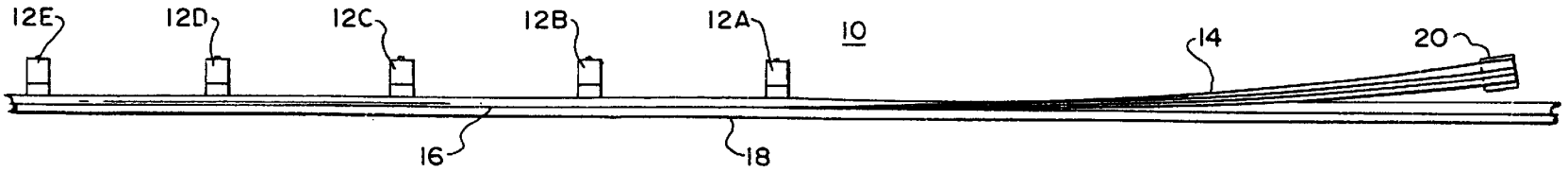
FIG. 2 is a plan view of the embodiment of FIG. 1.

In FIG. 2, there is shown a plan view of the drop-down section 16 of the guardrail assembly positioned adjacent to a curb 18 and on the opposite side of the curb from the roadway. The turned-down barrier section 14 is anchored at 20 adjacent to the ground with a galvanized steel anchor post assembly cast into reinforced concrete footing or an I-beam or channel pounded into the ground. The top of the terminal end of the anchor 20 is generally below the surface of the soil and welded to the barrier. The turned-down barrier section 14 then rises to a conventional height where it is mounted by a drop-down mounting to be described hereinafter to a number of post assemblies 12A–12E in FIG. 2 in the drop-down section 16. There are eight post assemblies in the preferred embodiment of drop-down section.

If the vehicle 11 (FIG. 1) impacts the guardrail at the turned-down section 14, it exerts pressure downwardly on the turned-down twisted section 14 creating a downward force in the direction of the angle of the twisted guardrail barrier and a torque about the connections at the post assemblies 12A–12E. That combination of forces, and perhaps residual force from the twisting of the guardrail, must be sufficient to pull the guardrail barrier free from the posts as the vehicle moves down the support posts, impacting the support posts to slow the vehicle down.

The direction of the forces obtained with the clockwise twist and resulting angle directs the force and resulting motion away from the support for the guardrail barrier in the drop-down section 16 causing the drop-down section 16 to reliably drop only upon collision by a vehicle. The clockwise twist avoids snagging of the barrier on the post to prevent it from falling. The posts must yield easily enough to avoid the center of mass of the vehicle rising and tipping the vehicle over and the guardrail must drop in front of the vehicle a sufficient distance to avoid tilting the vehicle upward or to one side or the other to cause it to turn over.

Figure 3:
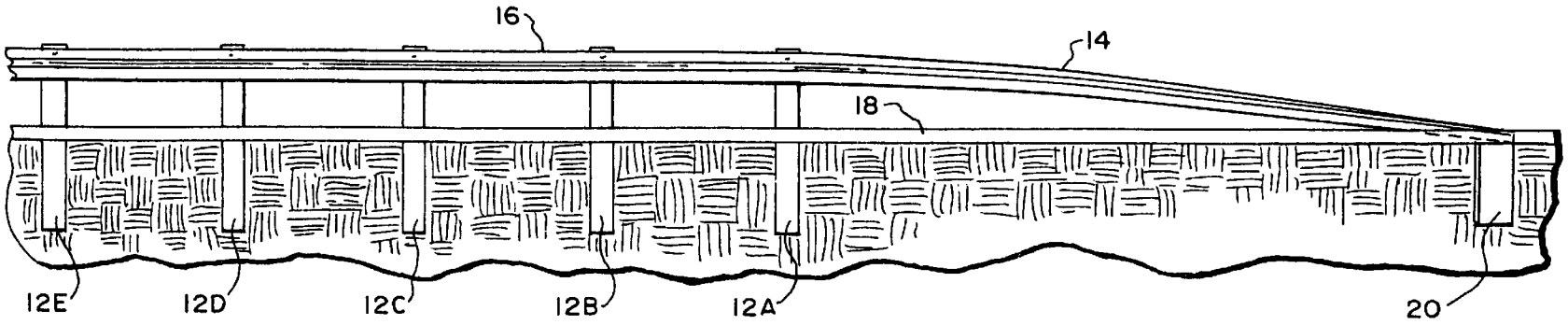
FIG. 3 is an elevational view of the embodiment of FIG. 2.

In FIG. 3, there is shown an elevational view of the embodiment of FIG. 2 showing the manner in which the end of the turned-down barrier section 14 is anchored at 20 to be near the ground and rise upwardly in the direction a vehicle hitting the terminal is moving thus avoiding spearing of vehicles and passengers in the vehicle. It rises upwardly to the normal height for the guardrail barrier and at that height joins the drop-down section 16 which is designed to remain at its elevation even though subject to vibrations and temperature changes and the like unless the guardrail terminal is impacted by a vehicle 11 (not shown in FIG. 3). When the guardrail terminal is impacted by a vehicle, sufficient torque and force is applied to cause the drop-down section 16 to pull free and drop to the ground to avoid launching the vehicle or rolling of the vehicle to one side.

In the embodiment of FIGS. 1–3, post one, 12A, is approximately 25 feet from the end 20 of the turned-down section 14 and the posts are six feet three inches apart. The drop-down section 16 starts at post one, at 12A, and extends to post nine (not shown). The turned-down section 14 and drop-down section 16 are at a slight angle to the curb to be offset from the roadway. However, the positioning of the post and the types of fastening between the posts and guardrail barrier are subject to variations depending on the conditions at the time.

Figure 4:
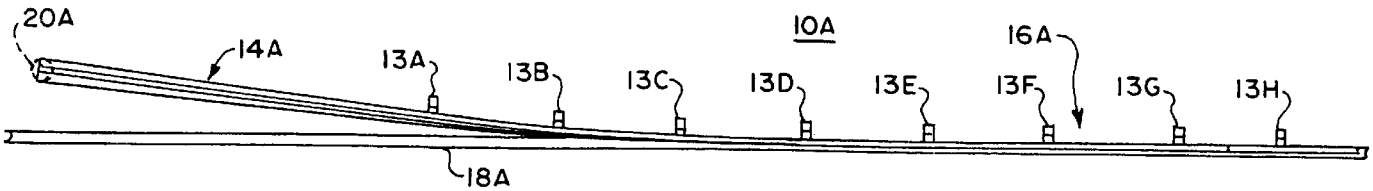
FIG. 4 is a simplified plan view of another embodiment of the invention.

In FIG. 4, there is shown another embodiment of turned-down guardrail terminal 10A having a turned-down barrier section 14A and a horizontal drop-down section 16A which joins the more firmly bolted portion 17 (FIG. 1) in the same manner as in the embodiment of FIGS. 1–3. The turned-down section 14A of the guardrail system 10A is also twisted in a clockwise direction to form a surface that the vehicle 11 (FIG. 1) impacts to pull the turned-down section 14A and the drop-down section 16A of the guardrail barrier from the posts 13A–13H in a manner similar to that described in connection with the embodiments of FIGS. 1–3.

In a manner similar to that of the embodiments of FIGS. 1–3, the drop-down section 16A of the guardrail assembly 10A is positioned adjacent to a curb 18A and on the opposite side of the curb from the roadway. The turned-down section 14A is anchored at 20A adjacent to the ground with an anchor plate connected to an I-beam or a steel channel pouned or otherwise placed in the ground. The combination of anchor and guardrail operates in a manner similar to the embodiments of FIGS. 1–3. In the embodiment of FIG. 4, the distance from the anchor at 20A perpendicularly to the curb 18A is 48 inches (121.9 centimeters); the distance from the post 13A to the curb 18A perpendicularly is 15 inches (381 millimeters); the distance between post 13B and the curb is 7.1 inches (180.6 millimeters); the distance between the post 13C and the curb 18A perpendicularly is 1.9 inches (48 millimeters) and the post 13D is mounted immediately adjacent to the curb.

The first post 13A is 750 centimeters from the end of the curb 18A and the distance of the fourth post 13D which is mounted right at the curb 18A is also 750 centimeters. The seventh post 13G is 750 centimeters from the fourth post 13D and the eighth post 13H is 190.5 centimeters from the seventh post 13G. The post spacing between the first and second posts, the second and third posts, the third and fourth posts, the fourth and fifth posts, the fifth and sixth posts, and the sixth and seventh posts is 2500 millimeters. After post eight, a standard W-beam rail is used in the preferred embodiment whereas a special W-beam to be described hereinafter starts at post 13A. The transition between the special W-beam and the standard W-beam occurs between the seventh post 13G and the eighth post 13H. The first through the sixth posts (13A–13F) are mounted by angled back-up plates to the barrier and the barrier is hand connected (by bolts in the preferred embodiment) at post one, 13A, and post four, 13D, to the angled back-up plate. At post seven, the barrier is hand connected to the post.

Figure 5:
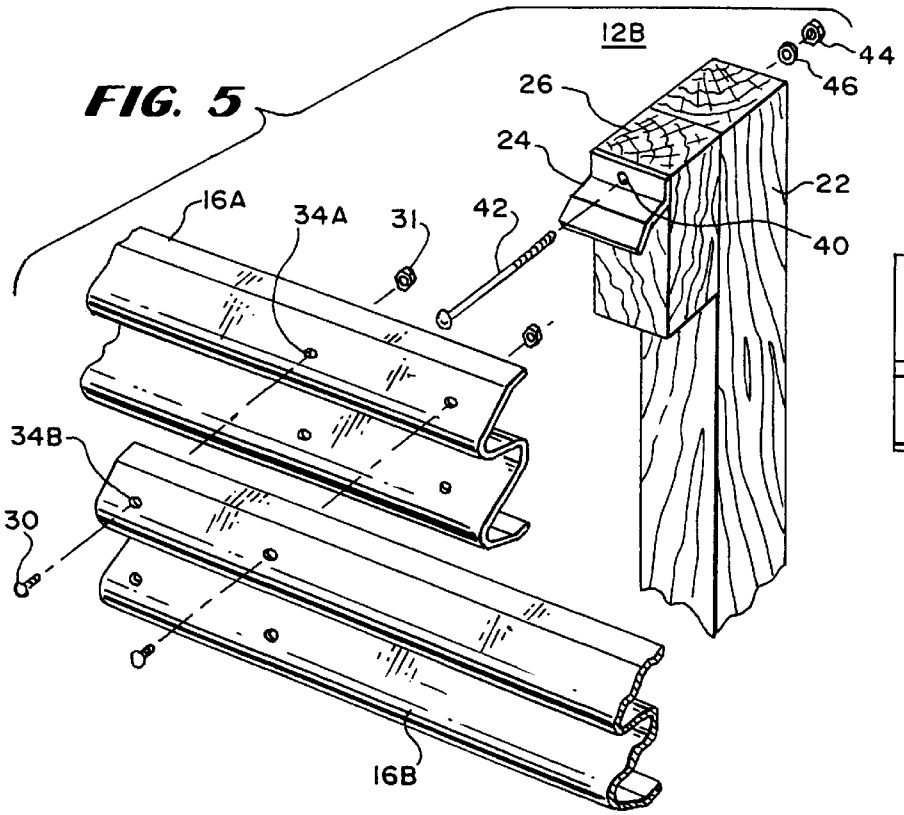
FIG. 5 is a fragmentary perspective view of a support post, knock-off block, back-up plate and guardrail barrier which may be used in the embodiment of FIGS. 1–4.

In FIG. 5, there is shown a simplified, exploded, fragmentary view of a post assembly 12B in the drop-down section 16 (FIGS. 1–3) having a wood post 22 weakened to break away when hit by a vehicle, an offset block 26, a back-up plate 24 and first and second guardrail barrier sections 16A and 16B. A bolt 42 passes through an opening in the center of the generally L-shaped back-up plate 24, through the offset block 26 and the wood post 22 to hold the three together by a washer and nut 46 and 44 respectively. The guardrail barrier sections 16A and 16B may be fastened together by bolts and nuts that pass through aligned apertures such as illustrated by the apertures 34A and 34B connected by a bolt 30 and a nut 31. They may be connected at four places through corresponding apertures or whatever number of places necessary to fasten them together.

The guardrail barriers 16A and 16B may be held to the post assembly 12B by fitting it in place over the complementarily shaped back-up plate 24 for support or they may be fastened by a nut and bolt through the aperture shown at 40. In the preferred embodiment, the post assembly 12A (FIGS. 1–3) just adjacent to the turned-down section 14 contains a back-up plate and drop-down guardrail barrier that are fastened together to avoid their falling down due to vibrations or other forces smaller than that normally imparted by collision with a vehicle. Other posts such as the second through the fifth posts 13B–13E and the seventh through the ninth posts are not hard connected together but there are bolts at the first and sixth posts 13A and 13F (FIG. 4).

The number of back-up plates and guardrail barriers that are fastened together rather than fitting together for support without a hard connection is determined by the amount of force expected to be necessary to cause it to drop-down upon collision with a vehicle and the amount of ambient forces that might occur from vibrations. Thus, the number of hard connections may be varied depending on the locations but there should be at least one hard connection at the first post.

Figure 6:
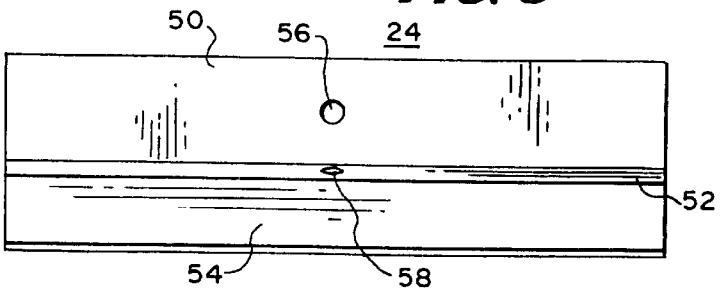
FIG. 6 is an elevational view of the back-up plate of FIG. 5.

In FIG. 6, there is shown a front elevational view of one embodiment of the back-up plate 24 having first, second and third metal plates 50, 52 and 54 respectively. The three plates are positioned at angles so that the first plate 50 may be bolted flush against the offset block 26 (FIG. 5) and to a peak of the barrier or beam. The second and third plates 52 and 54 are adjacent to the guardrail barrier or beam and shaped to support it in place with or without a hard connection such as a bolt connection. An aperture 56 in the first plate 50 accommodates the bolt 42 (FIG. 5) to permit the back-up plate 24 to be bolted to the offset block 26 and the wooden post 22 (FIG. 5). Similarly, an opening such as the one at 58 may be utilized to bolt the guardrail barrier to the back-up plate 24. Thus, the angles and sizes of the second and third plates 52 and 54 may be selected in accordance with the guardrail barrier and are different for a W-beam than for a C-beam guardrail barrier and differ with different dimensions of W-beams.

Figure 7:
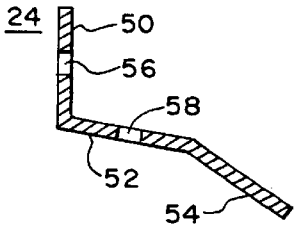
FIG. 7 is a side elevational view of the back-up plate of FIG. 6.

In FIG. 7, there is shown a side elevational view of the embodiment of back-up plate 24 showing an obtuse angle between the second plate 52 and the first plate 50 intended to match the angle of the edge of a W-beam. The third plate 54 is at an obtuse angle downwardly and of such a length as to provide additional support. However, these dimensions may be chosen in a different manner if desired. The opening 58 is intended to form a location for bolting the back-up plate 24 and the guardrail barrier together at some posts.

Figure 8:
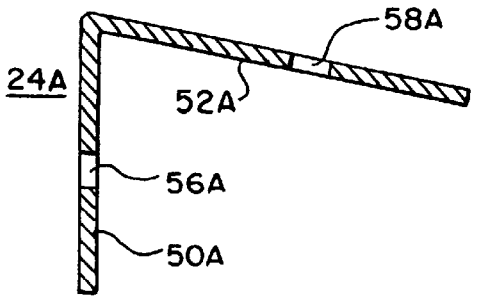
FIG. 8 is a side elevational view of another embodiment of back-up plate.

In FIG. 8, there is shown a side view of another embodiment of back-up plate 24A having a vertical section 50A with an aperture 56A for mounting to the post and a substantially horizontal section 52A having a bolt hole 58A for mounting to the underside of a special barrier or beam to be described hereinafter. The vertical section 50A of the back-up plate 24A is one and one-half inches in length and the substantially horizontal section 52A is 52 inches in length. The angle between the two sections 50A and 58A is 11.4 degrees from a plane perpendicular to the vertical section 50A.

Figure 9:
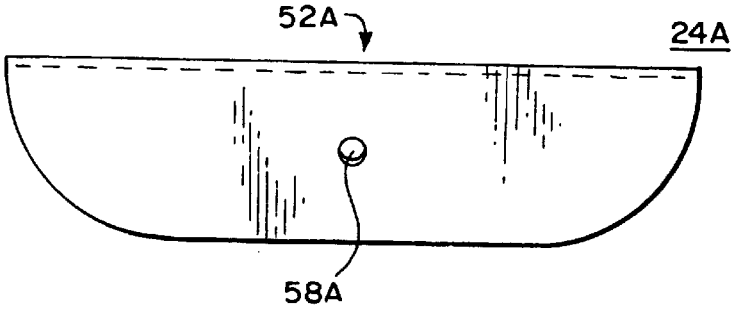
FIG. 9 is a top view of the back-up plate of FIG. 8.

In FIG. 9, there is shown a top view of the back-up plate 24A having a length at the edge between the sections 50A and 52A of 7.5 inches and rounded corners on the opposite side forming a radius of two inches. They are attached to the post by a 3" lag screw 4" long and at least is greater than 5/16th of an inch. They are attached to the rail by a number eight sheer bolt at the post with washers on both sides although a number 10 sheer bolt may be used. The rounded corners reduce the tendency to tear the barrier.

Figure 10:
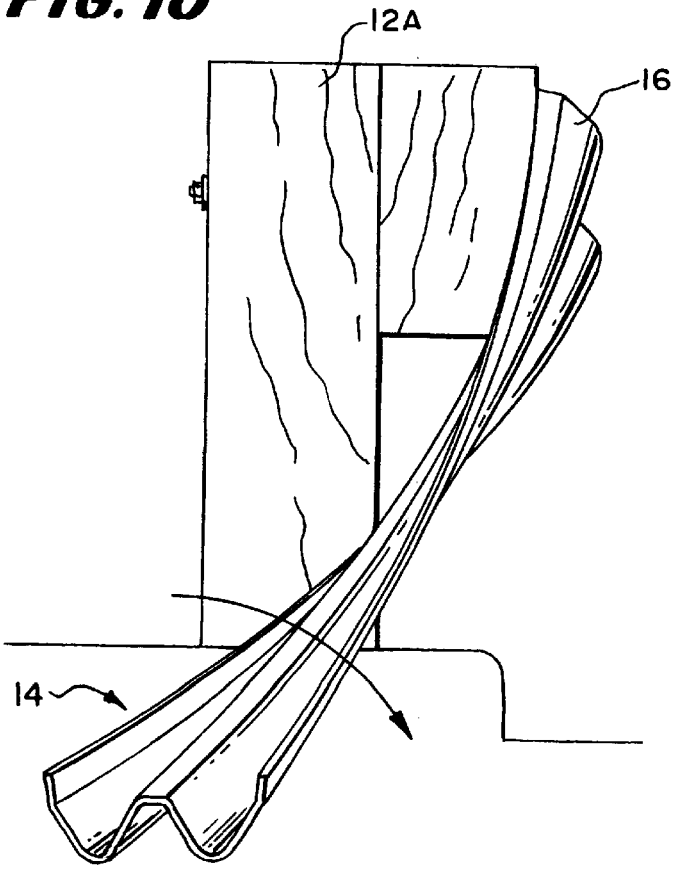
FIG. 10 is a fragmentary simplified view of a guardrail and support post near the turned-down end of a turned-down guardrail in accordance with an embodiment of the invention.

In FIG. 10, there is shown a fragmentary, simplified perspective view of a post assembly 12A, turned-down section 14 of a guardrail barrier and drop-down section 16 of the same guardrail barrier showing a clockwise twist between the section 16 and the section 14. This twist is selected so that torque applied at the fastener at the first post which together with the downward force exerted by the vehicle pulls the drop-down section 16 free and causes it to drop to a lower level. The prior art counterclockwise twist results in an angle that exerts less force upon the fastener in the most favorable direction upon the fastener for releasing the barrier and forces the guardrail into the post, thus preventing, under some circumstances, the guardrail barrier to drop-down. This endangers the vehicle of being vaulted up a ramp.

Figure 11:
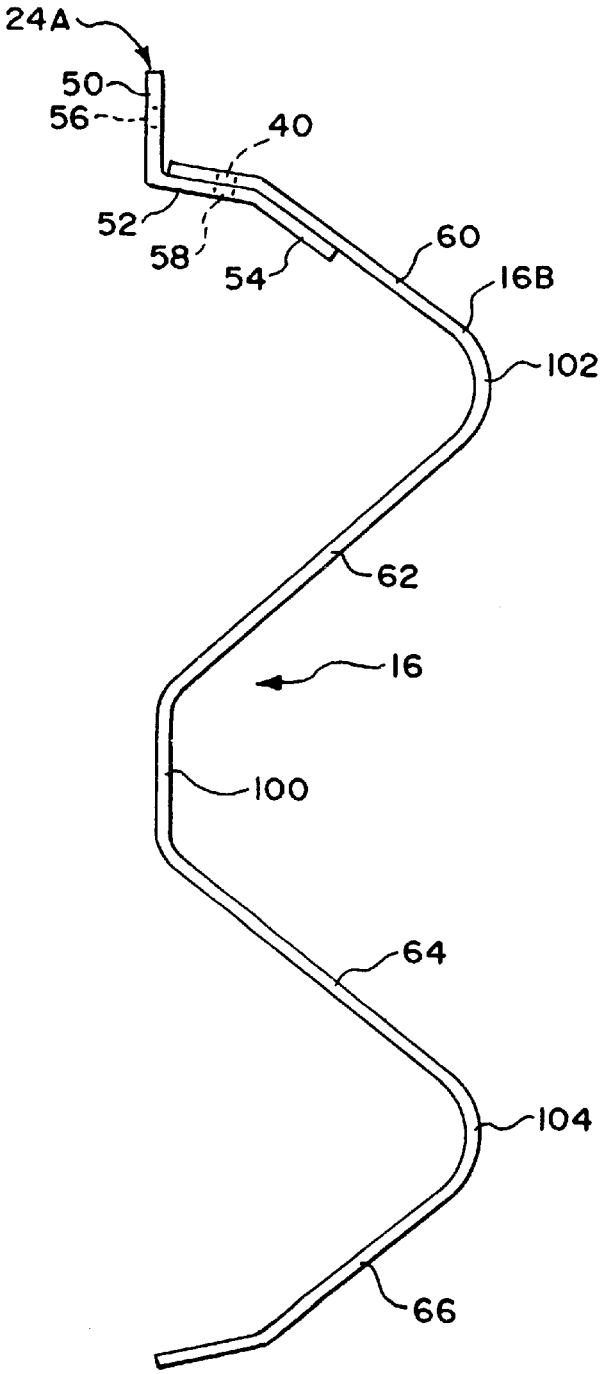
FIG. 11 is a side elevational view of a standard W-beam and novel back-up plate indicating bolt holes for attachment to the back-up plate of FIG. 5.

In FIG. 11, there is shown a typical standard W-beam guardrail barrier 16 and the back-up plate 24A of FIGS. 4, 5 and 6. It may either be fastened at the opening 40, to the back-up plate 24A, by bolts or be free and held only by being supported without a hard solid connection between it and the back-up plate 24A. The guardrail barrier 16 has an upper peak with an apex 102 and a lower peak with an apex 104 separated by a web 100 between the upper and lower peaks. A first angled section 60 extends outwardly from the top of the barrier to the upper peak apex 102, a second angled section 62 extends from the upper peak apex 102 to the upper edge of the web 100, a third angled section 64 extends from the edge of the web 100 and a fourth angled section 66 extends from the lower peak apex 104 to the lower end of the barrier.

Figure 12:
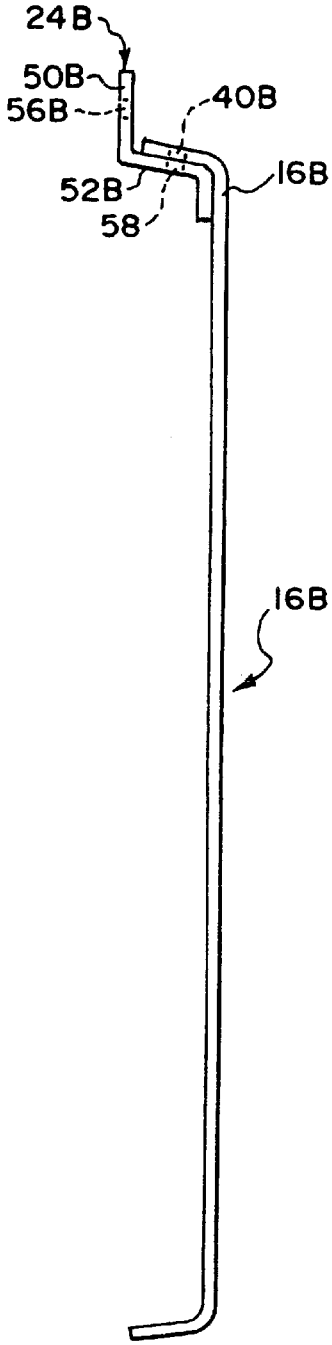
FIG. 12 is a side elevational view of a C-beam guardrail barrier and novel back-up plate usable in an embodiment of the invention.

In FIG. 12, there is shown another type of barrier 16B referred to as a C-beam barrier which may also be clamped in place and twisted in the same manner as the more common W-beam guardrail barrier but requires a different shaped back-up plate 24B. For example, the second and third plates 52 and 54 of the embodiment of FIG. 6 may have more obtuse angles to bring their apertures 58 more closely aligned with the aperture 40B of the C-beam.

The back-up plates 24–24B improve the reliability of dropping of the barrier in the drop-down section upon impact of a vehicle at the terminal compared with nested W-beams by reducing the tendency for an undesirable locking together of the barrier and the back-up plate to hold the barrier up. The prior art complementarily shape back-up plates for nesting of a barrier against the back-up plates in turned-down terminals result in two substantially horizontal or vertical surfaces of the back-up plate having downward force imparted to them from the barrier as a vehicle rides on top of the turned-down end of the barrier causing locking under some circumstances. The two surfaces are vertically spaced bottom surfaces of sections of the barrier that press against upper surfaces of the preior art back-up plates.

More specifically, with reference to the numeral in FIG. 11, the first or upper surface is the lower surface of the section 60 that extends from the top end of the barrier outwardly and downwardly toward the roadway to the upper peak 102 and which exerts a downward force upon the corresponding upper surface of the back-up plate that is complementarily formed and nested with the barrier. The second surface is the bottom surface of the section 64 that extends outwardly and downwardly from the lower end of the web 100 to the lower peak 104 which rests against a corresponding section of the back-up plate that is nested within it.

The novel angled back-up plates of this invention may take different shapes but are designed so that the projected upward area from the second surface and from the engaged webs is zero or sufficiently low to avoid undesirable locking of the plates together. For that purpose, the upward verticle projection from the second surface must be no more than four square inches of engagement between the angled back-up plate and the barrier when the projection is considered a projection onto a horizontal surface. Moreover, the connecting bolts between the barrier and the back-up plate must have a limited sheer strength such as less than 500 pounds of sheer force for rupturing and should have sizes of diameter no smaller than a number 14 bolt and no larger than a number 8 inch bolt or ¼ inch diameter bolt.

If these conditions are not met, it is possible to still have an operable back-up plate if the back-up plate pulls free at the bolt or lag screw hole 56. For that purpose, the strength of the back-up plate attachment to the wood posts in the preferred design has a ⅜ inch×4 inch lag screw and should not be any larger than a ⅝"×6" lag screw if it is to be withdrawn. Thus the withdrawal yielding force for the lag screw should have a horizontal component of force no lower than 704 pounds and no higher than 3,170 pounds for the preferred design and the vertical component of failing force should be no lower than 480 pounds and no higher than 602 pounds.

For the largest size lag screw, the horizontal required withdrawal force should be between 1,580 pounds and 6,970 pounds and the vertical force for pulling free should be no less than 1,290 pounds and no more than 1,806 pounds. The minimum maximum forces are the components in the downward direction and the withdrawal is the component in the horizontal direction but any combination resulting in the same vectored force at a downward angle should be considered as the equivelant of these vertical and horizontal forces. The yield moment of the foundation post to avoid failure at any point with no vehicle riding up them cannot be lower than 25,000 inch pounds.

In FIG. 13, there is shown a special barrier 16C generally configured as a W-beam but being formed of 13 gauge steel and adapted to be connected to the back-up plate 24A of FIGS. 8 and 9. It is symmetrical about a central web section 100 as shown in this view: (1) the distance between the plane of the web section 100 between the apex of the two peaks of 102 and 104 from the inside of the web section 100 referred to as the base to the inside of the peak is 78 millimeters; (2) the center of curvature of each peak is 54 millimeters from the base and has a radius of 24 millimeters ending on one side in a slanted straight portion extending three millimeters beyond the base of the web section 100 and on the other side being connected to an end of the web section 100 by a radius of curvature of 24 millimeters; (3) the center of curvature of each of the peaks 102 and 104 is 38 millimeters from its corresponding end of the barrier; and (4) the web section 100 starts 102 millimeters from the center of curvature of the peak 102 and is 108 millimeters long. Both peaks 102 and 104 have an upwardly extending portion 93 millimeters long in opposite directions from the web section 100 at angles of 43.6 degrees with respect to the web section 100. The highest point is 78 millimeters from the base and straight end members are 64 inches long at angles of 4.4 degrees with respect to the base.

In FIG. 14, there is shown an end view of an anchor 20 formed as a channel with a web portion 70 and perpendicular end portions 72A and 72B respectively. Corresponding connecting plates 74A and 74B are fastened to corresponding end portions 72A and 72B and angled upwardly and inwardly toward each other. The fastening plates are bolted or welded or fastened in some other manner to the corresponding ones of the end plates 72A and 72B to hold them in place and thus provide a surface for connecting to the barrier at the anchor. Preferably, the channel is pounded into the ground with the fastening plates extending for connection to the twisted barrier at the lower end of the twisted barrier.

In FIG. 15, there is shown a fragmentary side view of the barrier and fastening plates showing the fastening plates extending upwardly and inwardly. A channel is chosen as a substitute for the prior art reinforced concrete galvanized steel anchors for economy and reliability. Although a channel is a preferred configuration other configurations may be used, the configuration being chosen to provide high moment of inertia resistance and to be inexpensive to insert into the ground. Thus the channel may be simply pounded in and yet provide the desired moment of inertia for a sufficiently strong anchor.

In operation, a vehicle approaching the turned-down barrier section 14, exerts a force and a related torque on the twisted section 14 about the connecting points on the post 12A (FIG. 1) which is usually directed in a more favorable direction and amount by a clockwise twist of the guardrail barrier. Thus, as the vehicle begins to move up the turned-down section 14, the turned-down section 14 pulls free from the posts and drops down pulling the drop-down section 16 with it. This drop-down is expedited by the absence of hard connections on some of the posts, causing the guardrail barrier to be pulled more easily from them and add its weight to the torque and weight exerted by the vehicle to drop a sufficient amount of the drop-down section 16 and thus avoid directing the vehicle upward and launching it. The vehicle as it moves along the horizontal impacts the breakaway posts such as 12A and 12B and is slowed by them.

From the above description, it can be understood that the turned-down guardrail terminal of this invention has several advantages, such as: (1) the turned-down section 14 and drop-down section 16 of the guardrail barrier are held in place even though subjected to mild forces such as those caused by wind and vibration unless impacted by a vehicle; and (2) the turned-down section 14 and drop-down section 16 are reliably pulled free from the posts to drop-down when a vehicle impacts the terminal and thus avoids launching or turning the vehicle over.

While a preferred embodiment of the invention has been described with some particularity, many modifications and variations of the preferred embodiment are possible within the light of the above teachings. Therefore, it is to be understood that, within the scope of the appended claims, the invention may be practiced other than as specifically described.

What is claimed is:

1. A turned-down terminal for a guardrail system, comprising:

a drop-down section of guardrail barrier fastened to a plurality of posts in a manner permitting them to be pulled free the guardrail barrier having a front side that normally faces away from the posts and a rear side opposite the front side that normally faces the posts;

a turned-down section formed by twisting the guardrail clockwise to be at an angle so that the front side is positioned substantially facing the ground causing sufficient force and torque to pull at least a portion of the drop-down section of the guardrail barrier free upon being impacted with a vehicle.

2. A turned-down terminal in accordance with claim 1 in which certain of said plurality of posts include back-up plates, said back-up plates being bolted to said posts.

3. A turned-down terminal according to claim 2 in which certain of said back-up plates includes first and second sections integrally formed at an angle to each other, one of said first and second sections being fastened to said posts and the other to said guardrail.

4. A turned-down terminal for a guardrail system in accordance with claim 3 in which the backup plate has no second surface that exerts downward pressure on a guardrail barrier with a vertical projection into a horizontal plane of more than 4 square inches.

5. A turned-down terminal according to claim 1 having a first side, a second side, an end side and a connecting side, said first side being postiioned closer to a roadway than said second side, said end side being lower than said connecting side, said connecting side connecting the turned-down section to the drop-down section, the turned-down section of said guardrail barrier being twisted clock-wise when looking from said end side toward said connecting side and being fastened to at least certain of said posts on the first side of said posts.

6. A turned-down terminal in accordance with claim 5 in which certain of said plurality of posts include back-up plates, said back-up plates being bolted to said posts.

7. A turned-down terminal according to claim 6 in which certain of said back-up plates includes first and second sections integrally formed at an angle to each other, one of said first and second sections being fastened to said posts and the other to said guardrail.

8. A method of avoiding the spearing of vehicles or the launching or rolling of vehicles hitting a terminal end of a turned-down section of a guardrail, the turned-down section being formed by twisting the guardrail such that a front side of the guardrail which normally faces away from the guardrail posts is positioned substantially facing the ground, comprising the steps of:

causing the vehicle to contact a low portion of a guardrail terminal at its end prior to contacting higher portions of the terminal;

causing the portion of the terminal near its end to receive twisting forces in a clock-wise direction away from guardrail posts to pull free from the posts toward the roadway;

causing forces impacted by the vehicle to force the guardrail to drop down.

9. A method in accordance with claim 8 in which posts are knocked over by breaking at a weakened point as the vehicle impacts them so as to slow the vehicle down.

10. A method in accordance with claim 8 in which the guardrail is pulled from back-up plates by the force of the vehicle.

11. A method of making a turned-down terminal for a guardrail comprising the steps of:

mounting a row of posts along a roadside;

mounting a terminal end section of barrier twisted in a clock-wise direction with the top twisting in the direction of the roadway and away from the posts so that it is substantially flat and turning its distal end down close to the ground with a front side of the barrier which normally faces away from the posts positioned to substantially face the ground, wherein a vehicle impacting the terminal end pulls the guardrail down.

12. A method of making a turned-down guardrail in accordance with claim 11 in which the step of mounting a barrier includes the step of fastening the barrier to certain of said posts by back-up plates.

13. A back-up plate for a guardrail system comprising:

a first section adapted to be mounted to a post;

a second section adapted to be mounted to a guardrail barrier;

said second section being shaped and formed of a material that avoids resistance between a guardrail barrier and the back-up plate directed to prevent release of the barrier upon impacting of a turned-down terminal by a vehicle;

wherein there is no upwardly slanted surface adapted to engage the guardrail barrier with an area greater than four square inches when projected vertically.

14. A method of operation of a drop-down guardrail system in which a vehicle exerting force on a guardrail pulls the guardrail free without binding between the guardrail barrier and a back-up plate above an undesirable limit, comprising the steps of:

forming a back-up plate having first and second sections, wherein the first section is at an angle to the second section and the second section has rounded corners;

bolting the first section to a guardrail post wherein the second section slants downwardly and outwardly from the post with no surface to bind the guardrail when downward force is applied; and bolting the guardrail to the second section.

15. A W-beam comprising:

an upper peak and a lower peak with the upper peak having a first section adapted to extend outwardly in a relatively straight manner from a supporting post;

a second section extending inwardly from the upper peak to the post at an angle;

a third section extending from a web adjacent to a post outwardly to the apex of the lower peak; and a fourth section extending from the lower peak inwardly and downwardly toward the post and being relatively straight;

said first section and third section being separated by a web portion with said first section being adapted to receive a back-up plate and be bolted thereto wherein the back-up plate is bolted to only one of the first, second, third and fourth sections;

wherein the barrier is steel and is no thicker than 13 gauge with a distance outwardly perpendicularly from the base of the web to an apex of substantially 78 millimeters.

* * * * *